US005687653A

United States Patent [19]

Bumgarner

[11] Patent Number: 5,687,653

[45] Date of Patent: Nov. 18, 1997

[54] MODULAR METAL PALLET

[76] Inventor: Timothy R. Bumgarner, 22716 Via Santa Maria, Mission Viejo, Calif. 92691

[21] Appl. No.: 404,903

[22] Filed: Mar. 15, 1995

[51] Int. Cl.[6] ..... B65D 19/00

[52] U.S. Cl. ..... 108/51.1; 108/56.3

[58] Field of Search ..... 108/51.1, 56.1, 108/56.3, 901, 57.1; 248/346.02, 346.04, 346.06; 29/446, 448, 449

[56] References Cited

U.S. PATENT DOCUMENTS

| | | | |
|---|---|---|---|
| 2,447,556 | 8/1948 | Bitney . | |
| 2,492,626 | 12/1949 | Fletcher | 108/51.1 |
| 3,616,766 | 11/1971 | Weiss . | |
| 3,710,733 | 1/1973 | Story | 108/901 X |
| 3,757,704 | 9/1973 | Allgeyer et al. | 108/901 X |
| 3,762,344 | 10/1973 | Chez . | |
| 3,826,205 | 7/1974 | Weiss . | |
| 4,060,037 | 11/1977 | Gustafsson | 108/51.1 |
| 4,384,531 | 5/1983 | Spurgeon | 108/51.1 |
| 4,424,752 | 1/1984 | Aberg . | |
| 4,485,744 | 12/1984 | Umemura et al. . | |
| 5,042,396 | 8/1991 | Shuert | 108/51.1 |
| 5,343,814 | 9/1994 | Pigott et al. | 108/901 X |
| 5,367,960 | 11/1994 | Schleicher . | |

FOREIGN PATENT DOCUMENTS

| | | | |
|---|---|---|---|
| 219713 | 3/1968 | Sweden . | |
| 1454882 | 11/1976 | United Kingdom | 108/51.1 |

*Primary Examiner*—Peter M. Cuomo
*Assistant Examiner*—Janet M. Wilkens
*Attorney, Agent, or Firm*—Richard L. Myers

[57] ABSTRACT

A pallet having a loaded state and an unloaded state include the top section and a bottom section each having a generally planar configuration. Spacing members, which extend transverse to and between the first and second top sections include first spacing members having a fixed relationship with both the top section and the bottom section, and at least one spacing member having in the unloaded state a fixed relationship to the bottom section and a movable relationship with respect to the top section. Another of the spacing members is disposed at a corner of the pallet and has a cylindrical outer surface which defines the shape of the pallet at the associated corner. The pallet can be preloaded to increase the load capacity by compressing the top section to form a camber in the top section. Accordingly, the load capacity to pallet weight ratio can be significantly increased.

18 Claims, 4 Drawing Sheets

10
12
14
16
18
21
23
23e
24
25
26
27
28
29
30
32
34
36
38
41
43
45
50
52
54
56
61
63
65
67
70
72
74
81
83
85
87
90
134

MODULAR METAL PALLET

BACKGROUND OF THE INVENTION

1. Field of the invention

This invention relates generally to pallets and other load supporting platforms which are easily movable for example by a forklift.

2. Discussion of the Prior Art

A pallet is a portable platform typically used to receive a load and to facilitate transport of that load. The pallet typically has a load surface which is supported above ground height a distance merely sufficient to receive the tines of a forklift. Pallets are most commonly used in warehouses where the loads comprise pasteboard boxes filled with various products. Due to the significant weights associated with such loads and the nature of the handling by forklifts, the pallets must be able to withstand rough treatment.

It is important that the pallets provide a sufficient coefficient of friction with the load that no slippage occurs between the pallet and the load. The pallets must also be easily stored to ensure that they do not occupy considerable space in an unloaded state. Many pallets are used to handle produce in grocery stores. In these environments, it is important that the pallets not provide a source of bacteria which might contaminate the produce. Pallets are used in significant numbers and although reusable pallets are preferred, they often break or for other reasons must be sacrificed with only limited use.

In order to meet the stringent requirements of pallet strength, longevity, cleanliness and storability, pallets of the past have been formed from wood. The strength of wood is not uniform and consequently areas of weakness must be tolerated. As a result, on an industry wide basis, studies have shown that wood pallets produce about 1.7 turns, meaning that each pallet on average can be depended on for less than two uses before it must be sacrificed. With this low number of turns, the price of wood pallets can be significant.

Plastic pallets have also been used. Although the plastic material is more expensive than wood, the process for manufacturing is reduced. As a consequence the overall cost of plastic pallets is generally less than wood pallets. Nevertheless, the strength characteristics of plastic pallets are generally reduced from those of wood pallets. Plastic pallets also tend to be more slippery than wood. A load which shifts on its pallet generally has to be reloaded. In addition, there may be considerable damage to the load. In the past plastic pallets have been constructed with feet shaped in a cup configuration. Unfortunately the cupped feet have presented significant bacterial transmission problems in the produce environment. Furthermore, plastic pallets are generally known not be rackable since they do not span well. As a consequence, loads which are stacked on plastic pallets are typically transferred to wood pallets to facilitate storage on racks. Plastic pallets are brittle particularly in cold environments. When used to transport loads in aircraft, temperatures at 20,000 feet can cause a plastic pallet to break. When plastic breaks it tends to splinter and therefore offers a considerable risk to users. The federal Occupational Safety and Health Administration (OSHA) has addressed this risk as well as the significant volatility of the plastic material used in these pallets. When plastic pallets are stored, they present a fire hazard. As a consequence, OSHA has required that these pallets be stored in elaborate sprinkler rooms rather than ordinary warehouse when not in use.

Metal pallets have also been used. Generally they have a higher expense but offer a greater number of turns. Metal pallets of the past have been formed from structural materials such as I-beams and channels. Although these pallets offer relatively high strength characteristics, they are very heavy so that the strength-to-weight ratio is relatively low. Metal pallets have also been formed from sheet metal which is generally a gauged material. Sheet metal thicknesses, typically in a range between 16 Ga to 12 Ga inches, have added significantly to the weight of the pallets.

SUMMARY OF THE INVENTION

The pallets of the present invention overcome the afore mentioned deficiencies of the prior art. The pallets are formed from metal in the form of tubing which has relatively thin walls but very high structural characteristics. As opposed to structural steel and sheet metal, the tubing walls may have a thickness of only 0.035 to 0.090 inches. In cross-section, these walls extend continuously to form the tubing. In one configuration, the tubing may be formed by bending sheet material so that opposing edges can be brought into proximity and welded along the length of the tubing. Alternatively, the tubing can be extruded in a seamless form. In either case, the cross-sectional configuration of the tubing adds significantly to its structural characteristics so that the wall thickness is of less importance than it would be in the case of structural steel or even sheet metal.

While the tubing configuration increases the structural characteristics of the pallet, the reduced wall thickness configuration reduces the weight of the pallet. As a result, significantly higher load-to-weight ratios can be achieved. For example, pallets weighing in a range between 20 and 39 pounds can accommodate loads in a range between 2,000 and 8,000 pounds. This gives a load-to-weight ratio of about 200 which compares most favorably with prior art load-to-weight ratios of only 40 for wood pallets and 100 for plastic pallets.

The high load capacity can be enhanced by constructing the pallet with a preload. Such a preload is achieved in one method of construction by bending or bowing a section of the pallet in a direction which opposes any load placed on the pallet. As a consequence, the load capacity is increased by that amount of weight required to overcome the bend or preload in the pallet section.

The resulting pallet is not as slippery as the plastic pallets of the past. Nor does it present the fire problems associated with wooden pallets and particularly plastic pallets. It does not burn and consequently does not present any toxicity problems or high temperature problems. As a result, it can be stored in low cost conventional warehousing free of any requirement for a fire sprinkler system. The pallet of the invention does not present bacterial problems such as those associated with wood and plastic pallets. It is easily stackable, and more importantly, rackable. But perhaps of greatest interest is the fact that the tubular metal construction will provide a load-to-weight ratio which is more than twice that for pallets of the prior art. Furthermore, the tubular construction can withstand rough usage. Accordingly, it is contemplated that the number of turns will increase by a magnitude to between 20 and 30, for example.

In one aspect of the invention, the pallet has a loaded state and an unloaded state and comprises a top section disposed generally in a first plane and having a configuration including a plurality of sides alternating with corners of the top section. A bottom section disposed generally in a second plane is spaced from the first plane of the top section and has a configuration similar to the top section. Spacing means extending transverse to the first plane of the top section and the second plane of the bottom section maintains the top section and the bottom section in a spaced relationship. A plurality of first spacing members included in the spacing means has a fixed relationship with both the top section and the bottom section. At least one second spacing member is included in the spacing means and has in the unloaded state of the pallet a fixed relationship to one of the top section and the bottom section and a movable relationship with respect to the other of the top section and the bottom section.

In another aspect of the invention, the pallet includes a top section disposed generally in a first plane and having a configuration including a plurality of sides and a plurality of corners with each of the sides disposed between an associated pair of the corners. A bottom section is disposed generally in a second plane and spaced from the first plane of the top section. Spacing means extends transverse to the first plane of the top section and the second plane of the bottom section and maintains the top section and the bottom section in a spaced relationship. At least one spacing member is included in the spacing means and is disposed in an associated one of the corners of the top section. The at least one spacing member has an outer surface with a cylindrical configuration which defines the shape of the pallet at the associated corner of the top section.

In an additional aspect of the invention, a pallet has a free state in the absence of a load, and an operative state in the presence of a load, and a load capacity. The pallet comprises a first section having a generally planar configuration which is sized to receive the load. A second section also has a generally planar configuration. A plurality of spacers are disposed in transverse relationship with the first section and the second section, the spacers functioning to maintain the first section and the second section in a spaced relationship. The first section is bowed away from the second section a distance sufficient to preload the first section in order to increase the load capacity of the pallet.

In a further aspect of the invention, the method for making the pallet is disclosed. This method includes the steps of forming a top section with a plurality of sides and a plurality of corners, the sides collectively defining the perimeter of the top section with each of the sides disposed between an associated pair of the corners. The method also includes the step of forming a bottom section with a generally planar configuration and coupling to the bottom section a plurality of spacing members which maintain the top and bottom sections in a spaced relationship. The pallet is preloaded to increase the load capacity of the pallet.

These and other features and advantages of the invention will become more apparent with a discussion of preferred embodiments and best mode of the invention, and reference to the associated drawings.

DESCRIPTION OF PREFERRED EMBODIMENTS

Figures 1, 2, 11, 12:
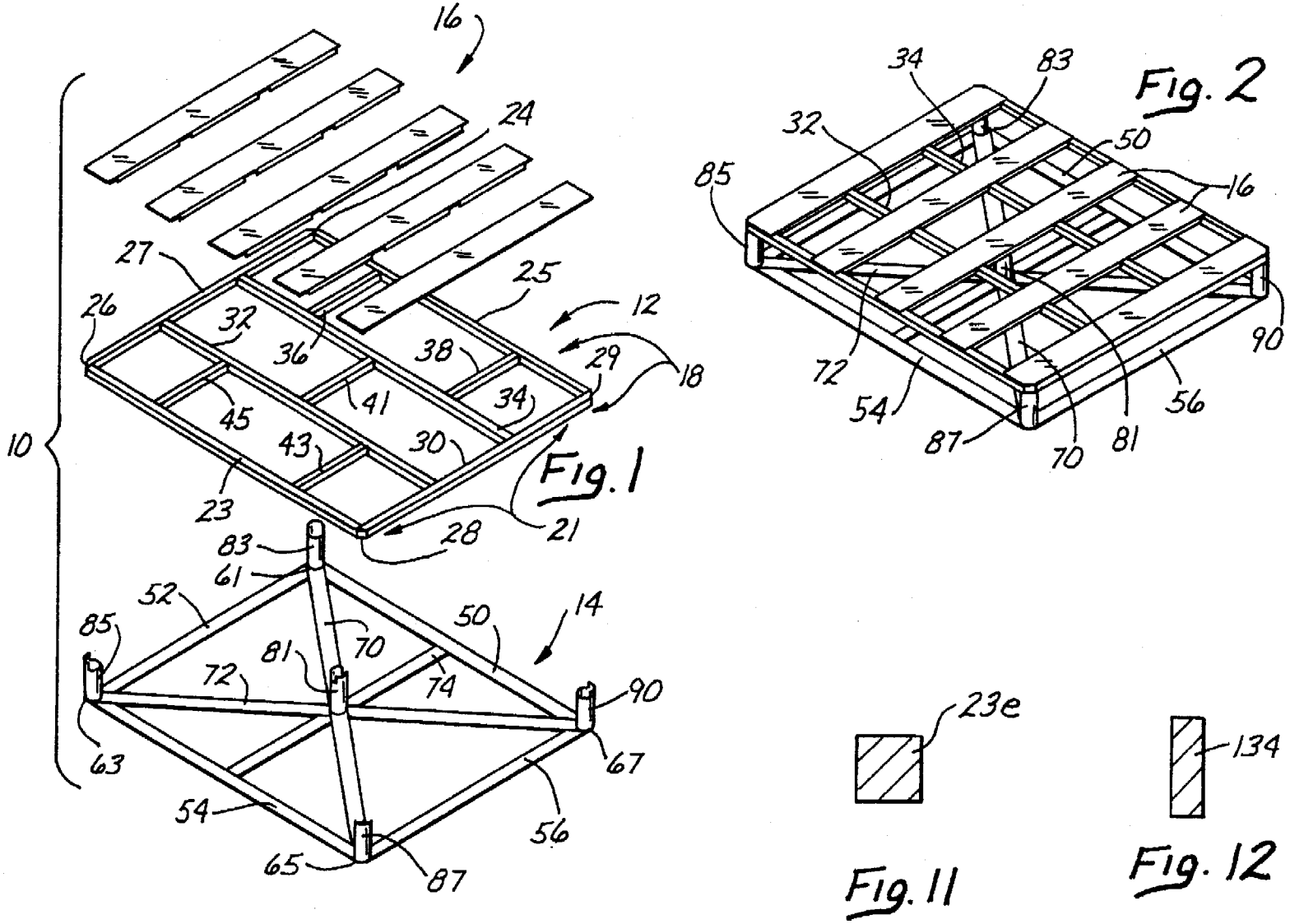
FIG. 1 is an expanded perspective view of a preferred embodiment of the pallet of the present invention.
FIG. 2 is an assembled view of the pallet illustrated in FIG. 1.
FIG. 11 is a cross-section view of one of the tubing members taken along lines 11—11 of FIG. 8.
FIG. 12 is a cross-section view of one of the tubing members taken along lines 12—12 of FIG. 9.

A pallet is illustrated in the exploded view of FIG. 1 and designated generally by the reference numeral 10. In this view, the pallet is separated into subassemblies including a top section 12, a bottom section 14, and a plurality of surface members 16.

The top section 12 has a generally planar configuration and a shape including a plurality of sides 18 alternating with corners 21. For example, in a preferred embodiment, the top section 12 has a rectangular configuration wherein the sides 18 are formed by a pair of long perimeter members 23, 25 alternating with a pair of short perimeter members 27, 30. Adjacent pairs of the perimeter members 23, 25, 27 and 30 intersect at corners 24, 26, 28 and 29 of the pallet 10. Extending between the perimeter members 23–30, are a plurality of structural members including for example a pair of backbone members 32, 34 and several rib members designated in the FIG. 1 embodiment by the reference numerals 36, 38, 41, 43, and 45. A primary purpose of the members 23, 25, 27, 30, 32, 34, 36, 38, 41, 43, and 45 of the top section 12 is to resist compressive stresses, tensile stresses, and particularly bending stresses. Of particular interest to the top section 12 specifically and the pallet 10 in general, is the tubular configuration of the members 23, 25, 27, 30, 32, 34, 36, 38, 41, 43, and 45. This feature will be discussed in greater detail below.

In the embodiment illustrated in FIG. 1, the bottom section 14 has a rectangular shape similar to that of the top section 12. This bottom section 14 includes perimeter members 50, 52, 54, and 56 adjacent pairs of which define corners 61, 63, 65 and 67. When fully assembled, as illustrated in FIG. 2, the corners 24, 26, 28 and 29 of the top section 12 correspond to the corners 61, 63, 65 and 67 of the bottom section 14.

The bottom section 14 will typically include cross members 70 and 72 each of which extends between opposing corners. For example, the diagonal member 70 extends between the corner 61 and 65, while the diagonal 72 extends between the corner 73 and 67. The bottom section may also include one or more cross members which extend transversely between opposing perimeter members. In the illustrated embodiment, a cross member 72 extends generally perpendicular to and between the perimeter members 50 and 54. In a preferred embodiment, at least one of the cross members, such as the cross member 74 preferably extends through the intersection of the diagonal members, such as the diagonal member 70, 72. When the pallet 10 has a rectangular configuration, this point of intersection, designated generally by the reference numeral 76, will define the center of the pallet area.

The function of the members 50, 52, 54, and 56 and 70, 72, 73, and 74 of the bottom section 14 is primarily to resist tensile stresses. With this primary requirement, these members generally can be formed from strip material in a preferred thickness range of 1/32 to 1/8 inch, or alternatively, sheet metal having a thickness range of 20 Ga to 10 Ga. Although these members of the bottom section 14 could also be formed of tubular material, the reduced thickness of the strip material will be preferred to facilitate operation with a fork lift. Completing the construction of the pallet 10 are the surface members 16 which are generally configured to extend across the top section 12 and provide a substantially planar surface to support the pallet load. In the illustrated embodiment, the surface members 16 extend between and generally perpendicular to the long perimeter members 23 and 25.

The bottom section 14 may also include spacing members such as those designated by the reference numerals 81, 83, 85, 87 and 90. When the pallet is fully assembled, the spacing members 81, 83, 85, 87 and 90 extend between the top section 12 and bottom section 14. In the illustrated embodiment, the spacing members 81, 83, 85, 87 and 90 are formed in a cylindrical configuration where the axis of each cylinder extends generally perpendicular to the planes of the top section 12 and bottom section 14. With the surface member 16 mounted on the top section 12, the spacing members 81, 83, 85, 87 and 90 support the top section 12 in an elevated position so that the tines of a forklift can extend between the bottom section 14 and top section 12 to engage the pallet 10.

The completed construction of the embodiment illustrated in FIG. 1 is shown in FIG. 2. In this view, the top section is mounted on the spacing members 81–90 in spaced relationship with the bottom section 14. In addition, the surface members 16 have been operatively disposed on the top section 12. An advantage of particular significance to this embodiment of the invention is associated with the spacing members 81, 83, 85, 89 and 90 which have a rounded outer surface which is characteristic of their cylindrical configurations. With the spacing members 83, 85, 87 and 90 disposed in the corners 61, 63, 65, and 67 respectively, these outer surfaces provide the pallet 10 with a rounded configuration at their associated corners. With this rounded configuration at the corners, the pallet 10 avoids sharp edges which might otherwise result in injury to those walking or otherwise working around the pallet 10.

Other embodiments of the bottom section 14 of the pallet 10 are illustrated in FIGS. 3–6. In these embodiments, structural elements which are similar to those previously described will be designated by the same reference numeral followed by a lower case letter appropriate to that embodiment. For example, in FIG. 3 a bottom section **14*a* is illustrated to include only two diagonals 70*a* and 72*a*. The diagonal 70*a* extends between the corners 61*a* and 65*a* and supports spacing members 83*a* and 87*a* at those respective locations. Similarly, the diagonal 72*a* extends between corners 63*a* and 67*a* with spacing members 85*a* and 90*a* disposed at those respective locations. This embodiment provides perhaps the simplest construction for a bottom section 14, a construction which benefits from the diagonal forces attributable to the members 70*a* and 72*a*. This simple construction also provides five spacing members including a spacing member 81*a* disposed at a center 76*a***.

Figure 4:
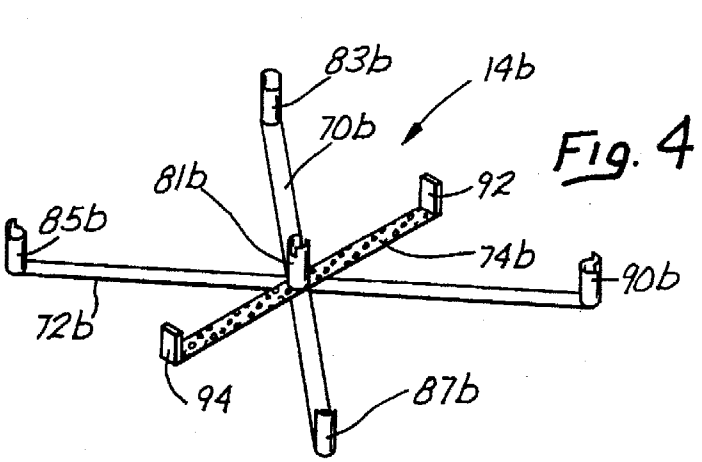
FIG. 4 is a perspective view of a bottom section in an additional embodiment of the invention.
Figure 3:
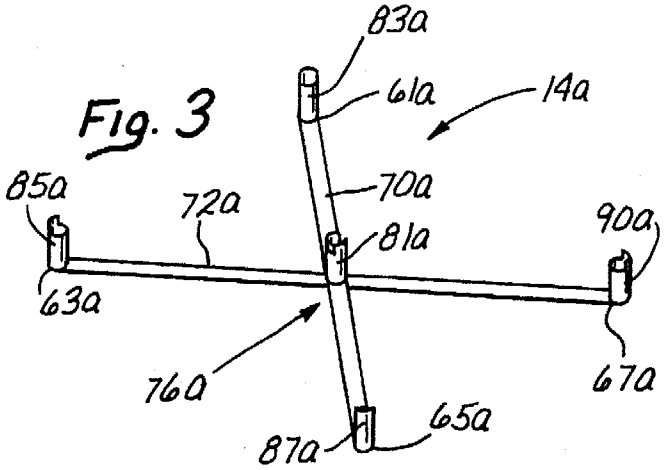
FIG. 3 is a perspective view of a bottom section in another embodiment of the invention.

In FIG. 4, an additional embodiment is illustrated with the bottom section designated by the reference numeral **14*b*. This embodiment is similar to that of FIG. 3 in that it includes diagonals 70*b* and 72*b* as well as spacing members 81*b*, 83*b*, 85*b*, 87*b* and 90*b*. In addition, a cross member 74*b* has been provided in order to support additional spacing members 92 and 94 at its ends. In this embodiment, the spacing members 92, 94 provide intermediate support for the long perimeter members 23 and 25 illustrated in FIG. 1. In FIG. 4, the strip material forming the cross member 74*b* is illustrated to be perforated. Perforation such as this can greatly reduce the weight of the pallet 10 without a significant sacrifice to the tensile strength of the members such as the cross member 74*b***.

Figure 5:
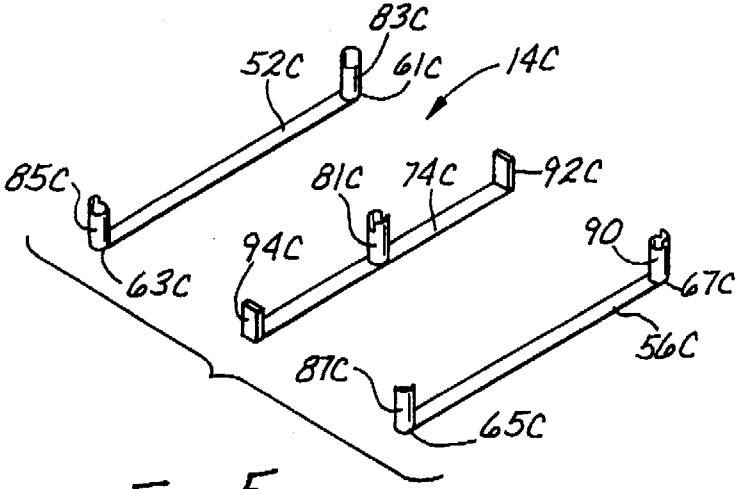
FIG. 5 is a perspective view of a bottom section in a further embodiment of the invention.

In FIG. 5, the bottom section is designated by the reference numeral **14*c*. In this embodiment, the bottom section consists of three separate members 52*c*, 74*c* and 56*c*. As in the FIG. 1 embodiment, the member 52*c* extends between corners 61*c* and 63*c*where spacing members 83*c* and 85*c* are located. Similarly, the member 56*c* extends between corners 65*c* and 67*c* where the spacing members 87*c* and 90*c* are located respectively. The cross member 74*c* supports spacing members 92*c* and 94*c* at its ends and a spacing member 81*c* intermediate its ends. This embodiment provides a total of seven spacing members with a minimum length for the strip members. On the other hand, it is somewhat more difficult to manufacture since the members 52*c*, 56*c* and 74*c* are not interconnected until the top section 12** is brought into place.

Figure 6:
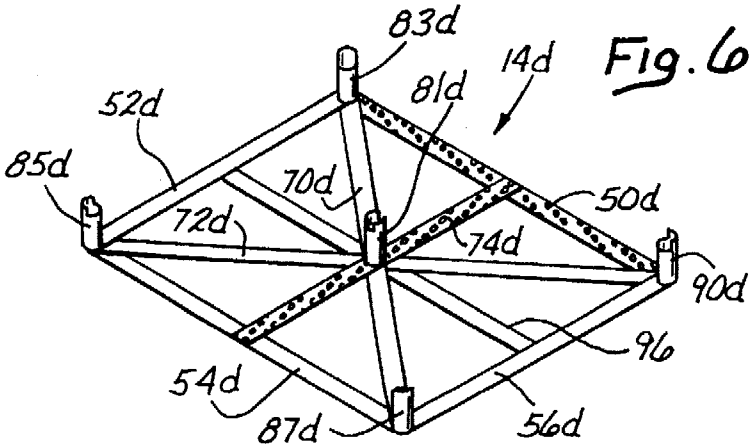
FIG. 6 is a perspective view of a bottom section in still a further embodiment of the invention.
Figure 7:
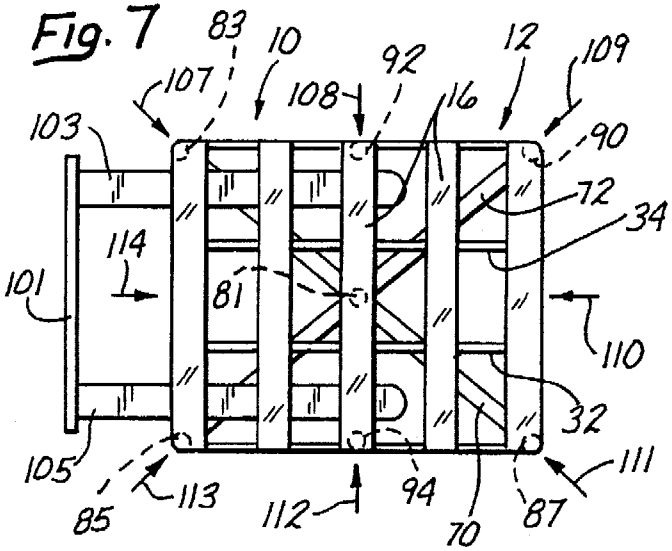
FIG. 7 is a perspective view of a body section similar to that illustrated in FIG. 3 and showing the eight directions of approach applicable to the foregoing embodiments of the invention.

A bottom section **14*d* is illustrated in the embodiment of FIG. 6. This embodiment is similar to that illustrated in FIG. 1 with the further addition of a cross member 96 which extends between and perpendicular to the perimeter members 52*d* and 56*d*. Otherwise it includes the perimeter members 50*d*, 54*d*, cross member 74*d* and diagonal members 70*d* and 72*d*. It also includes the spacing members in the form of feet 81*d*, 83*d*, 85*d*, 87*d* and 90*d*. In this embodiment, the cross member 74*d* and perimeter member 50*d* are both illustrated to be perforated. Of course this can be an alternative construction for any of the perimeter members 50*d*, 52*d*, 54*d* and 56*d*, cross members 74*d*, 96, or diagonal member 70*d*, 72*d*. Each of these bottom sections 14, 14*a*–14*d* has a common advantage associated with the spacing members of feet 81, 83, 85, 87 and 90. With this configuration wherein the spacing members form feet which are vertically oriented, the pallet can be approached by a forklift from eight separate directions. As illustrated in FIG. 7, a forklift having a fork 101 including tines 103 and 105 can approach the pallet 10 from any one of eight directions as represented by the arrows 107–114. From any one of these directions, the tines 103, 105 of the fork 101 will clear the feet 81, 83, 85, 87, 90, 92 and 94 to permit the fork 101 to fully engage the top section 12 of the pallet 10**.

Figure 8:
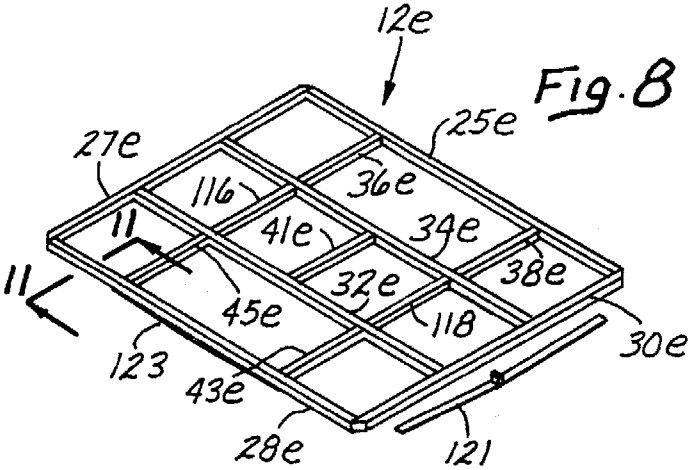
FIG. 8 is a perspective view of a frame of a top section in a preferred embodiment of the invention.
Figure 9:
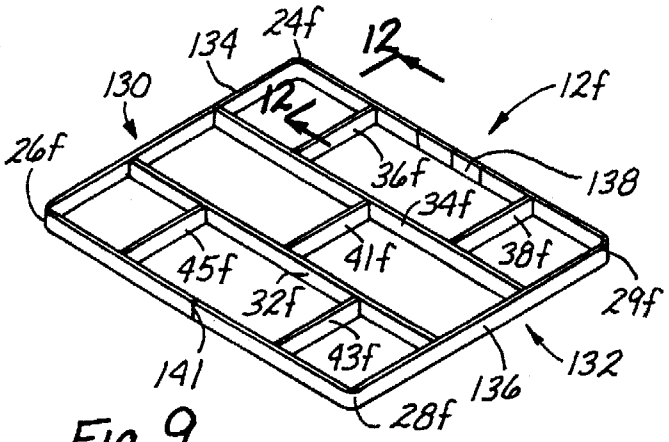
FIG. 9 is a perspective view of a frame in a top section of an additional embodiment of the invention.

Alternative embodiments of the top section 12 are illustrated in FIGS. 8 and 9 where items of structure similar to those previously discussed are designated by the same reference numerals followed by the lower case letters e and f respectively. Accordingly, in FIG. 8, the top section 12*e* is formed from perimeter members 23*e*, 25*e*, 27*e* and 30*e* backbone members 32*e*, 34*e* and rib members 36, 38, 41, 43 and 45. Distinguishing the embodiment of FIG. 1 are additional rib members 116 and 118 which span the backbones 32*e* and 34*e* in line with the rib members 36*e*, 45*e* and 38*e*, 43*e* respectively.

In some cases, it may be desirable to reinforce the longer members such as the perimeter members 23*e*, 25*e* or the backbones 32*e*, 34*e*. These reinforcing members can take the form of additional feet disposed along these spans, such as the feet 92 and 94 illustrated in FIGS. 4 and 5. Alternatively, additional support can be provided along the spans of these members by trusses which can be provided along each of the members. A truss of this type may be similar to that illustrated in FIG. 8 and designated by the reference numeral 121. This truss 121 is illustrated below its associated perimeter member 30*e* for clarity. An additional truss 123 is illustrated in operative disposition relative to its associated perimeter member 23*e*. With any tendency of the perimeter member, such as the member 23*e* or 30*e*, to bend, the associated truss, such as the truss 123 or 121 respectively, would resist that tendency to bend.

A further embodiment of a top section 12 is illustrated in FIG. 9 and designated by the reference numeral 12*f*. This embodiment of the top section 12*f* is similar to those previously discussed except that the tubing forming the perimeter of the top section 12*f* is formed in two sections designated by the reference numerals 130 and 132. Each of the perimeter sections 130 and 132 is formed from a single piece of tubing which is bent at 90° angles to form the corners of the top section 12*f*. For example, the perimeter section 130 includes a single perimeter member 134 which is bent to form the corners 24*f* and 26*f*. This bending provides the perimeter section 130 with a U-shape where the bottom of the U-shape forms the short side of the rectangular top section 12*f*, and the legs of the U-shape extend along the long side of the rectangular top section 12*f*.

In a similar manner, the perimeter section 132 is formed from a single perimeter member 136 which is bent to form the corners 28*f* and 29*f*. The bottom of the U-shape perimeter member 136 forms the opposing short side of the rectangular top section 12*f*. The legs of the U-shaped section extend along the long sides of the top section 12*f* where they engage the legs of the U-shaped perimeter member 134.

Where the legs of the perimeter member 134 join the legs of the perimeter member 136, a connecting means can be provided to hold these sections 130, 132 in a fixed relationship. The connecting means can take the form of an outer sleeve 138 which engages the tubing of the respective members 134, 136 along its outer surface. The connecting means may also take the form of an insert 141 which is disposed inwardly of the tubing members 134, 136. In either case, welding will facilitate this permanent connection of the perimeter members 134 and 136.

Interiorly of the perimeter sections 130, 132, the backbones 32*f* and 34*f*, together with the ribs 36*f*, 38*f*, 41*f*, 43*f* and 45*f* can be provided in any of the configurations previously discussed.

Figure 10:
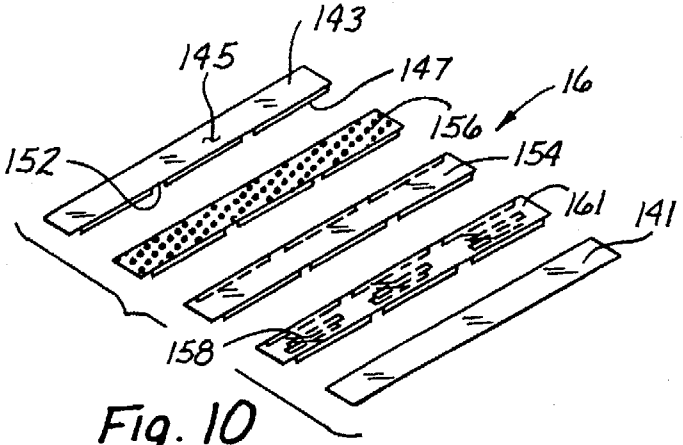
FIG. 10 is a perspective view of various embodiments which are contemplated for top members in a top section of the pallet.

Referring now to FIG. 10, one can see a variety of surface members 16 which may be used in a particular design of the pallet 10. These surface members 16 will typically all have the same configuration. However, that configuration may vary as required by a particular design. One of the variations is represented by the surface member 141 which has a simple planar configuration. Planar members, such as the member 141, can be merely laid on top of the top section 12*f* and spot welded into place.

An alternative construction is illustrated by a top member 143 which, in addition to providing a major planar surface 143, includes longitudinal edge portions 147 which are bent transverse to the surface 145. These edge portions 147 add further resistance to any tendency of the surface member 143 to bend. Slots 152 can be provided between the longitudinal edge portions 147 to accommodate the backbones 32 and 34 of the top section 12. The longitudinal edge portions 147 can be formed along only one of the longitudinal edges of the surface member, as illustrated for the member 143, or it can be formed along both longitudinal edges as illustrated for a surface member 154.

A further alternative for the surface members 16 would be to form them out of a perforated sheet metal material as illustrated by a surface member 156.

In addition to the longitudinal portions 147, other means for inhibiting the bending of the surface member may take the form of structural members 158 which can be welded into place along the bottom of the surface member, as illustrated for a surface member 161 in FIG. 10. These structural members 158 are preferably longitudinal in configuration and can be bent into a cross section such as the letter "Z" to inhibit the bending characteristics of the structural member 158 and the associated surface member 161.

Of particular interest to the present invention is the configuration of the various members 23, 25, 27, 30, 32, 34, 36, 38, 41, 43 and 45 which form the top section 12. These members are formed from tubing which typically have wall thicknesses less than 0.120 inch. Such tubing is relatively light in weight but has a high structural rigidity. As a consequence, forming the top section 12 from tubing members provides the pallet 10 with high strength characteristics, but very low weight characteristics. The strength of the pallet 10 is most apparent in its load capacity, the weight of load which can be supported on the pallet 10.

The strength of the pallet is also dependent upon the configuration and placement of the spacing members or feet 81, 83, 85, 87 and 90. In a preferred embodiment, these feet 81, 83, 85, 87 and 90 are also formed from tubing. In a preferred embodiment the tubing is cylindrical and has a diameter of about 1.5 to 2 inches. The walls of this tubing can also have a minimum thickness such as 0.035 inches. With the tubing of the feet 81, 83, 85, 87 and 90 oriented with the axis of the cylindrical configuration extending between and perpendicular to the top section 12 and bottom section 14, the spacing members or feet 81, 83, 85, 87 and 90 have a high resistance to crushing.

Not only is the strength of the pallet 10 increased, but the overall weight of the pallet is substantially decreased compared to structures of the prior art. For example, for a given pallet size such as 40"×48", and a given pallet load capacity such as 2800 pounds, wooden pallets of the past have weighed as much as 67 pounds. The pallet of the present invention, given the same size and load capacity considerations, weighs only 29 pounds. It follows that a wooden pallet of this configuration would have a weight to area ratio of about 5. The area to weight ratio of a pallet formed in accordance to the present invention would be only about 2 pounds per square foot. This is a reduction of more than 60% in the weight of the pallets for a given size and load capacity.

The tubing forming the top section 12 and the spacing members or feet 81, 83, 85, 87 and 90 can be formed in any manner common to the trade. In some cases, the tubing is formed from long pieces of sheet material where the longitudinal edges are bent into proximity and welded along a longitudinal seam. This configuration might be particularly appropriate for the feet 81, 83, 85, 87 and 90 which will typically have a larger cross-sectional dimension than the tubing associated with the top section 12. Other types of tubing are commonly available and are perhaps more suitable for the top section 12. This type of tubing is formed by extrusion so that no seam is formed along the tubing.

Tubing is available in a variety of cross-sectional sized and shapes. However, characteristic of all tubing is its thin walls which equate to low weight, and its high resistance to bending which equates to high strength. In general, any cross-sectional shape for the tubing could be used for the pallet 10. However, the cross-sectional shapes most appropriate are those which provide a flat surface on which the load of the pallet can be placed. Thus a cross-sectional configuration may include any polygon such as a square-shape which is used in a preferred embodiment. In this embodiment, the tubing forming the members 23, 25, 27, 30, 32, 34, 36, 38, 41, 43 and 45 of the top section 12 is square in cross-section with each side of the square having a dimension such as one inch.

Advantage can be taken of the fact that some cross-sectional shapes have a greater resistance to bending in one direction than in another direction. Such is the case with the rectangular shape where the resistance to bending is greatest along the longitudinal dimension of the rectangle. If the tubing forming the members 23, 25, 27, 30, 32, 34, 36, 38, 41, 43 and 45 is formed of rectangular tubing, this longitudinal dimension can be oriented vertically, generally perpendicular to the plane of the pallet. This orientation provides the top section 12 with an even further increased structural rigidity. Other means for increasing the structural rigidity of the top section 12*f* include the truss 121 as previously discussed.

The use of tubing for the members 23, 25, 27, 30, 32, 34, 36, 38, 41, 43 and 45 is particularly beneficial in this environment where low pallet weight and high pallet load capacity are appreciated. In the past, pallets formed from wood or plastic have had load capacities in a range between 1000 pounds and 4000 pounds. These pallets typically have had a weight ranging between 39 pounds and 104 pounds. A typical load capacity to weight ratio for a wood pallet would be about 40, and for a plastic pallet about 100. With the pallets of the present invention formed from steel tubing, load capacities can be increased to a range between 2000 pounds and 8000 pounds while holding the weight of the pallet 10 to a range of 20 pounds to 39 pounds. With this construction, it can be seen that the load capacity to weight ratio increases to about 200.

Figure 13:
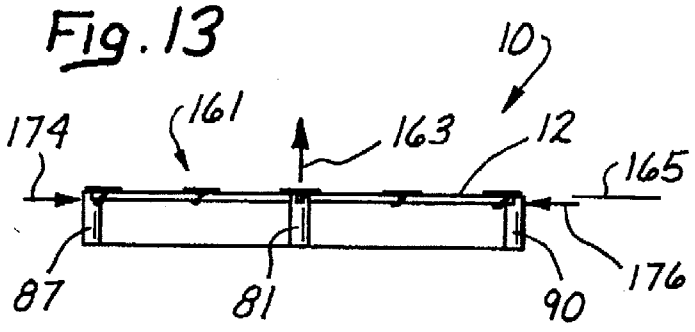
FIG. 13 cross-sectional exploded view of the pallet taken along lines 11—11 of FIG. 8 and illustrating a preferred step in a method for manufacturing the pallet.

A further increase in the load capacity, without any increase in the weight of the pallet 10 can be achieved by preloading the pallet. This is accomplished by configurating the pallet in a manner whereby it is prebent in the direction opposing the weight of the load. With this prebending or preloading of the pallet, additional load capacity is achieved. This additional capacity equates to the amount of load required to remove the prebend from the pallet. This brings the pallet configuration back to a planar state where the standard load capacity can still be accommodated. This prebend or preload is best illustrated in FIG. 13 where a bend or camber in the top section 12 is accentuated at the center of the pallet 10, which is designated by the reference numeral 161. In this area, the top section 12 is bent upwardly in the direction of arrow 163 when the pallet is unloaded. When a load is initially placed on the pallet it first resists this preload by bending the top section 12 in a direction opposite to the arrow 163 until it achieves its generally planar configuration illustrated by a reference plane 165 in FIG. 13. By preloading the pallet 10, the standard load capacity may be increased by as much as 34%. Thus, if a particular pallet without preloading had a load capacity of 3000 pounds, that capacity might be increased to 4000 pounds by prebending or preloading the pallet. As noted, this increase in load capacity generally equates to the amount of weight required to drive the prebent top section back to the reference plane 165.

Figure 14:
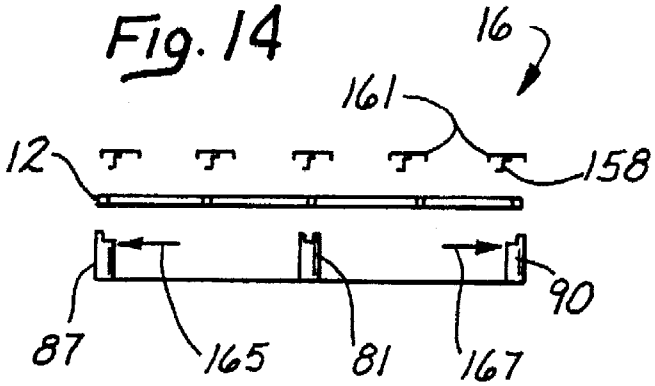
FIG. 14 is a cross-section view taken along lines 11—11 of FIG. 2 and illustrating a further step in the process for manufacturing the pallet.

The prebending or preloading of the pallet is accomplished in a preferred method of construction which primarily involves the bottom section 14 including the spacing members or feet 81, 83, 85, 87 and 90. As illustrated in FIG. 14, the perimeter feet 83, 85, 87 and 90 can initially be mounted, such as welded, to the members 50, 52, 54, 56, 61, 63, 65, 67, 70, 72 and 74 associated with the bottom section 14. In this initially welded state, the feet 83, 85, 87 and 90 are bent outwardly, for example in the directions illustrated by the arrows 165 and 167, so that the dimension separating the tops of the feet 81, 83, 85, 87 and 90 is greater than the dimension separating the bottom of the feet 81, 83, 85, 87 and 90. While the distance separating the bottoms of the feet 81, 83, 85, 87 and 90 generally equates to the dimensions of the top section 12, the distances separating the tops of the feet 83, 85, 87 and 90 is initially greater than the dimensions of the top section 12.

Figure 16:
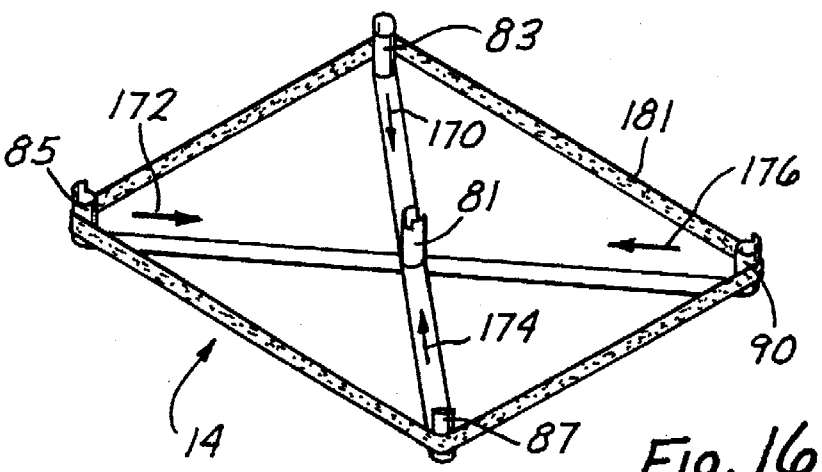
FIG. 16 is a top schematic view of a pattern of the spacers where preload compression is applied circumferentially of the pallet.
Figure 15:
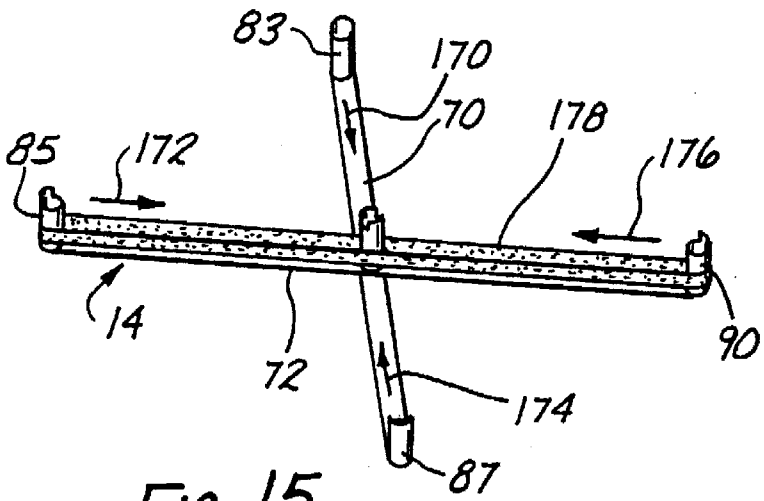
FIG. 15 is a top plan schematic view of a pattern of spacers where the preload compression is applied along diagonal pairs of the spacers.

In order to bring the feet 83, 85, 87 and 90 into alignment with the top section 12, the feet can be bent inwardly in a direction opposite to the arrows 165 and 167. This of course places a bending load between the feet 83, 85, 87 and 90 and the members 50, 52, 54, 56, 61, 63, 65, 67, 70, 72 and 74 which form the bottom section 14. In a preferred method, straps are placed around the feet 83, 85, 87 and 90, as illustrated in FIGS. 15 and 16, in order to produce forces tending to bend the feet 81, 83, 85, 87 and 90 inwardly. These forces for example may extend along arrows 170, 172, 174 and 176. In FIG. 15, a strap 178 is illustrated which extends between the feet 85 and 90. Tightening this strap introduces a bending moment or preload into the bottom section 14 by bending the feet 85 and 90 in the direction of the arrows 170 and 174, respectively.

In the method step illustrated in FIG. 16, a strap 181 extends around all of the feet 83, 85, 87 and 90 at the corners of the bottom section 14. Tightening this strap 181 also moves the feet 83, 85, 87 and 90 in the direction of the arrows 170, 172, 174 and 176.

With the feet 83, 85, 87 and 90 bent inwardly to introduce a preload into the bottom section 14, the top section 12 can now be lowered into place on top of the feet 83–90. Welding the top section 12 into this operative position will stress the top section 12 into the bent or cambered state illustrated in FIG. 13. Effectively, the preload in the bottom section 14 is transferred, at least in part, to the top section 12 in order to achieve the camber 161.

It will be noted that each of the feet 83–90 on the perimeter of the pallet 10 can be connected, such as welded, to each of the bottom section 14 and the top section 12. However, feet that are disposed interiorly of the pallet perimeter, such as the center foot 81, may not be attached to both the bottom section 14 and top section 12 as it would inhibit formation of the camber 161. Therefore, in a preferred embodiment, the interior feet, such as the center foot 81 is attached to only one of the sections 12 or 14, such as the bottom section 14, and is left unattached to the other of the sections 12 and 14, such as the top section 12. This enables the preload or camber 161 to form in the top section 12 as it floats under the weight of the load between the camber 161 and the reference plane 165.

Although the inward bending of the perimeter feet 83, 85, 87 and 90 is shown in both FIGS. 15 and 16 to be along the diagonal members 70 and 72, inward bending of the perimeter feet 83–90 can also be along the perimeter members 50, 52, 54 and 56 which are illustrated in FIG. 1. Other methods for bending the feet to introduce a preload into the pallet 10 will be readily apparent in view of the foregoing description.

It will be apparent that many modifications to these preferred embodiments will capture the spirit and advantages of this concept. Use of tubing, particularly in the top section 12 will generally provide high strength, low weight characteristics regardless of the particular configuration of the pallet 10. Tubing with a wide variety of cross-sections will generally achieve this advantage although polygonal cross-sections may be preferred. Those cross-sections providing increased bending resistance in a particular direction may also be preferred if that direction is oriented in opposition to the load on the pallet. The introduction of any preload into the pallet can be highly advantageous as it increases the load capacity without any increase in the weight. Load capacity to weight ratios can be significantly increased with this pallet construction and method of manufacture.

Given these wide variations, which are all within the scope of this concept, one is cautioned not to restrict the invention to the embodiments which have been specifically disclosed and illustrated, but rather encouraged to determine the scope of the invention only with reference to the following claims.

I claim:

1. A pallet having a loaded state and an unloaded state, comprising:

a top section disposed generally in a first plane and having a configuration including a plurality of sides alternating with corners of the top section;

a bottom section disposed generally in a second plane spaced from the first plane of the top section and having a configuration similar to the top section;

spacing means extending transverse to the first plane of the top section and the second plane of the bottom section for maintaining the top section and the bottom section in a spaced relationship;

a plurality of first spacing members included in the spacing means and having a fixed relationship with both the top section and the bottom section; and at least one second spacing member included in the spacing means and having in the unloaded state a fixed relationship to one of the top section and the bottom section, and a movable relationship with respect to the other of the top section and the bottom section;

wherein the configuration of the other of the top section and the bottom section includes a camber.

2. The pallet recited in claim 1 wherein the top section has the camber and the at least one second spacing member has the fixed relationship with the bottom section.

3. The pallet recited in claim 1 wherein each of the plurality of first spacing members is disposed at an associated one of the corners of the top section and has a rounded outer surface which defines the shape of the pallet at the associated corner of the top section.

4. The pallet recited in claim 1 wherein the configuration of the top section at one of the sides of the top section is generally straight and the pallet further comprises:

means disposed along the one side of the top section for maintaining the generally straight configuration of the one side of the top section.

5. The pallet recited in claim 4 wherein the maintaining means comprises a third spacing member disposed along the one side in a transverse fixed relationship to the top section and the bottom section.

6. The pallet recited in claim 4 wherein the maintaining means comprises a truss extending along the one side of the top section.

7. The pallet recited in claim 1 wherein the top section has a center disposed generally equidistant from the corners of the top section and the second spacing member is disposed at the center of the top section.

8. The pallet recited in claim 1 having a pallet weight and a pallet area, wherein the ratio of the pallet weight to pallet area is not greater than about two pounds per square foot.

9. The pallet recited in claim 1 having a load capacity and a pallet weight, and wherein the ratio of the load capacity to pallet weight is greater than 60.

10. A pallet having a loaded state and an unloaded state, comprising:

a top section disposed generally in a first plane and having a configuration including a plurality of sides alternating with corners of the top section, the top section at one of the sides of the top section having a generally straight configuration;

a truss extending along the one side of the top section for maintaining the generally straight configuration of the one side of the top section;

a bottom section disposed generally in a second plane spaced from the first plane of the top section and having a configuration similar to the top section;

spacing means extending transverse to the first plane of the top section and the second plane of the bottom section for maintaining the top section and the bottom section in a spaced relationship;

a plurality of first spacing members included in the spacing means and having a fixed relationship with both the top section and the bottom section; and at least one second spacing member included in the spacing means and having in the unloaded state a fixed relationship to one of the top section and the bottom section, and a movable relationship with respect to the other of the top section and the bottom section.

11. A metal pallet having a loaded state and an unloaded state, comprising:

a metallic top section disposed generally in a first plane and having a configuration including a plurality of sides and a plurality of corners with each of the sides disposed between an associated pair of the corners;

a metallic bottom section disposed generally in a second plane spaced from the first plane of the top section;

metallic spacing means extending transverse to the first plane of the top section and the second plane of the bottom section for maintaining the top section and the bottom section in a spaced relationship;

at least one spacing member included in the spacing means and disposed at an associated one of the corners of the top section, the at least one spacing member having an outer surface which defines the shape of the pallet at the associated corner of the top section; and at least one second spacing member included in the spacing means and having in the unloaded state a fixed relationship to one of the top section and the bottom section, and a movable relationship to the other of the top section and the bottom section.

12. A metal pallet having a free state in the absence of a load, an operative state in the presence of a load, and a load capacity, the pallet comprising:

a metallic first section sized to receive the load, the first section including at least one metallic perimeter member defining opposite edges of the first section, and at least one metallic structural member coupled to the at least one perimeter member and extending between the opposite edges of the first section;

a metallic second section having a generally planar configuration;

a plurality of spacers disposed in transverse relationship to the first section and second section, the spacers maintaining the first section and the second section in a spaced relationship; and the first section having a reference plane which is parallel to the generally planar configuration of the second section and being bowed away from the second section a distance sufficient to preload the first section when the pallet is in the free state in order to increase the load capacity of the pallet by an amount equivalent to the weight required to deform the top section from the bowed configuration to the reference plane when the pallet is in the operative state.

13. The pallet recited in claim 12, wherein the at least one perimeter member and the at least one structural member are formed from metal tubing.

14. A metal pallet having a free state in the absence of a load, an operative state in the presence of a load, and a load capacity, the pallet comprising:

a first section sized to receive the load and including at least one perimeter member formed from metal tubing, the at least one perimeter member defining at least one side of the first section;

a metallic second section having a generally planar configuration;

a plurality of spacers disposed in transverse relationship to the first section and second section, the spacers maintaining the first section and the second section in a spaced relationship; and the first section having a reference plane which is parallel to the generally planar configuration of the second section and being bowed away from the second section a distance sufficient to preload the first section when the pallet is in the free state in order to increase the load capacity of the pallet by an amount equivalent to the weight required to deform the top section from the bowed configuration to the reference plane when the pallet is in the operative state.

15. A metal pallet having a free state in the absence of a load, an operative state in the presence of a load, and a load capacity, the pallet comprising:

a metallic first section sized to receive the load;

a metallic second section having a generally planar configuration;

at least one metallic surface member supported by the first section, the at least one surface member defining a platform for receiving the load;

a plurality of spacers disposed in transverse relationship to the first section and second section, the spacers maintaining the first section and the second section in a spaced relationship; and the first section having a reference plane which is parallel to the generally planar configuration of the second section and being bowed away from the second section a distance sufficient to preload the first section when the pallet is in the free state in order to increase the load capacity of the pallet by an amount equivalent to the weight required to deform the top section from the bowed configuration to the reference plane when the pallet is in the operative state.

16. The pallet recited in claim 15, wherein the platform for receiving the load comprises a plurality of generally planar surface members.

17. The pallet recited in claim 15, wherein the metallic first section comprises a plurality of tubular elements.

18. The pallet recited in claim 15, wherein the metallic first section comprises:

at least one metallic perimeter member defining at least one side of the first section; and at least one metallic structural member coupled to the at least one perimeter member and extending between the opposite edges of the first section.

* * * * *